US010726774B2

(12) United States Patent
Hao et al.

(10) Patent No.: US 10,726,774 B2
(45) Date of Patent: Jul. 28, 2020

(54) BACKLIGHT DRIVING CIRCUIT AND METHOD, BACKLIGHT MODULE, BACKLIGHT CIRCUIT AND DISPLAY DEVICE

(71) Applicants: BEIJING BOE DISPLAY TECHNOLOGY CO., LTD., Beijing (CN); BOE TECHNOLOGY GROUP CO., LTD., Beijing (CN)

(72) Inventors: Wei Hao, Beijing (CN); Feifei Wang, Beijing (CN); Luqiang Guo, Beijing (CN); Jieqiong Wang, Beijing (CN); Ziqiang Guo, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 3 days.

(21) Appl. No.: 16/209,360

(22) Filed: Dec. 4, 2018

(65) Prior Publication Data

US 2019/0340972 A1 Nov. 7, 2019

(30) Foreign Application Priority Data

May 4, 2018 (CN) ..... 2018 1 0418821

(51) Int. Cl.

*G09G 3/34* (2006.01)
*G09G 3/32* (2016.01)
*G09G 3/20* (2006.01)

(52) U.S. Cl.

CPC ..... *G09G 3/32* (2013.01); *G09G 3/2088* (2013.01); *G09G 2310/0264* (2013.01)

(58) Field of Classification Search

CPC .... G09G 3/3406; G09G 3/3413; G09G 3/342; G09G 3/3426; G09G 3/2088; G09G 3/32; (Continued)

(56) References Cited

U.S. PATENT DOCUMENTS

2013/0050167 A1* 2/2013 Yamanaka ..... G09G 5/003 345/211
2015/0356925 A1 12/2015 Lee et al.
(Continued)

FOREIGN PATENT DOCUMENTS

CN 101266371 A 9/2008
CN 102682701 A 9/2012
(Continued)

OTHER PUBLICATIONS

First Office Action for Chinese Application No. 201810418821.5, dated Jun. 27, 2019, 9 Pages.

*Primary Examiner* — Dennis P Joseph
(74) *Attorney, Agent, or Firm* — Brooks Kushman P.C.

(57) ABSTRACT

A backlight driving circuit includes a backlight driving sub-circuit. The backlight driving sub-circuit includes at least one voltage receiving end; at least two switch sub-circuits and at least two driving ends. The voltage receiving end is connected to first electrodes of at least two light emitting elements. Second electrodes of the at least two light emitting elements are connected to first ends of the at least two switch sub-circuits, respectively. The control end of each switch sub-circuit receives a switch control signal. The second end of each switch sub-circuit is connected to a corresponding driving end. The first end and the second end of the switch sub-circuit are connected or disconnected under the control of the switch control signal.

19 Claims, 6 Drawing Sheets

(58) Field of Classification Search
CPC ..... G09G 3/3258; G09G 3/3233; G09G 2320/064; G09G 2310/0264
See application file for complete search history.

(56) References Cited

U.S. PATENT DOCUMENTS

| | | | | |
|---|---|---|---|---|
| 2018/0197479 | A1 | 7/2018 | Chen | |
| 2018/0277036 | A1* | 9/2018 | Maeda | G09G 3/32 |
| 2018/0357948 | A1* | 12/2018 | Chen | G09G 3/2074 |

FOREIGN PATENT DOCUMENTS

| | | | |
|---|---|---|---|
| CN | 102750911 | A | 10/2012 |
| CN | 103971642 | A | 8/2014 |
| CN | 106097972 | A | 11/2016 |
| CN | 205722747 | U | 11/2016 |

* cited by examiner

BACKLIGHT DRIVING CIRCUIT AND METHOD, BACKLIGHT MODULE, BACKLIGHT CIRCUIT AND DISPLAY DEVICE

CROSS-REFERENCE TO RELATED APPLICATION

This application claims priority to Chinese Patent Application No. 201810418821.5 filed on May 4, 2018, which is incorporated herein by reference in its entirety.

TECHNICAL FIELD

The present disclosure relates to the field of backlight driving technology, in particular to a backlight driving circuit and method, a backlight module, a backlight circuit and a display device.

BACKGROUND

Mini LED (sub-millimeter light emitting diode) is used as a backlight. Due to a large number of Mini LEDs are used, it can be divided into thousands of partitions for finer backlight adjustment for a better HDR (High-Dynamic Range) effect. However, there is currently no dedicated IC (Integrated Circuit) for driving sub-millimeter LEDs. An existing backlight driving chip can control a limited number of LEDs (channels), generally 16 channels. The number of backlight driving chips required to drive sub-millimeter light emitting diodes is large and the cost is high.

SUMMARY

In one aspect, a backlight driving circuit includes at least two switch sub-circuits; at least two driving ends; and a backlight driving sub-circuit. The backlight driving sub-circuit comprises at least one voltage receiving end; the voltage receiving end is connected to first electrodes of at least two light emitting elements, second electrodes of the at least two light emitting elements are connected to first ends of the at least two switch sub-circuits, respectively; and a control end of each switch sub-circuit receives a switch control signal, a second end of the switch sub-circuit is connected to a corresponding driving end, a first end of the switch sub-circuit and the second end of the switch sub-circuit are connected or disconnected under the control of the switch control signal.

In some embodiments, a first electrode of the light emitting element is cathode, and a second electrode of the light emitting element is anode, the driving end is configured to input a turn-on voltage, and the backlight driving sub-circuit is configured to control a corresponding voltage receiving end to receive a first voltage under the control of a corresponding pulse width modulation signal, the first voltage is less than the turn-on voltage, and a voltage difference between the turn-on voltage and the first voltage is greater than a voltage for turning on the light emitting element.

In some embodiments, the backlight driving sub-circuit further includes at least one current control unit, and each current control unit corresponds to a voltage receiving end; the current control unit comprises a switch module and a current control module; a first end of the switch module is connected to a corresponding voltage receiving end, a second end of the switch module is connected to a corresponding first voltage input end, and a control end of the switch module receives a corresponding pulse width modulation signal, the corresponding voltage receiving end and the corresponding first voltage input end are connected or disconnected by the switch module under the control of the corresponding pulse width modulation signal, the first voltage input end is configured to input the first voltage; and the current control module is configured to, when the corresponding voltage receiving end and the corresponding first voltage input end are connected by the switch module, adjust a current value of a backlight driving current flowing through the light emitting element to a predetermined current value by adjusting the turn-on voltage.

In some embodiments, a first electrode of the light emitting element is anode and a second electrode of the light emitting element is cathode, the driving end is configured to input a cathode voltage, and the backlight driving sub-circuit is configured to control the corresponding voltage receiving end to receive a second voltage under the control of a corresponding pulse width modulation signal, the second voltage is greater than the cathode voltage, and a voltage difference between the second voltage and the cathode voltage is greater than a voltage for turning on the light emitting element.

In some embodiments, the backlight driving sub-circuit further includes at least one current control unit, and each current control unit corresponds to a voltage receiving end; the current control unit comprises a switch module and a current control module; a first end of the switch module is connected to a corresponding voltage receiving end, a second end of the switch module is connected to a corresponding second voltage input end, and a control end of the switch module receives a corresponding pulse width modulation signal, the switch module is configured to connect or disconnect the corresponding voltage receiving end and the corresponding second voltage input end under the control of the corresponding pulse width modulation signal, the second voltage input end is configured to input the second voltage; and the current control module is configured to, when the switch module connects the corresponding voltage receiving end and the corresponding second voltage input end, adjust a current value of a backlight driving current flowing through the corresponding light emitting element to a predetermined current value by adjusting the cathode voltage.

In some embodiments, the switch sub-circuit includes a first switching transistor, a second switching transistor, a first resistor, a second resistor, a third resistor, and a fourth resistor; a first electrode of the first switching transistor is the first end of the switch sub-circuit, and a second electrode of the first switching transistor is the second end of the switch sub-circuit; a gate electrode of the second switching transistor is the control end of the switch sub-circuit, and a first electrode of the second switching transistor is connected to a gate electrode of the first switching transistor through the second resistor, the second electrode of the second switching transistor is connected to a low level input end; the first resistor is connected between the first electrode of the first switching transistor and the gate electrode of the first switching transistor, and the third resistor is connected to the gate electrode of the second switching transistor and the low level input end; and the first switching transistor is a p-type transistor, and the second switching transistor is an n-type transistor.

In some embodiments, the switch sub-circuit includes a switching transistor, a first resistor, a second resistor, and a third resistor; a gate electrode of the switching transistor is connected to a first end of the second resistor, a first electrode of the switching transistor is the first end of the switch sub-circuit, and a second electrode of the switching transistor is the second end of the switch sub-circuit; a second end of the second resistor is the control end of the switch sub-circuit; the first resistor is connected between the gate electrode of the switching transistor and the first electrode of the switching transistor, and the third resistor is connected between to the second electrode of the switching transistor and a low level input end; and the switching transistor is a p-type transistor.

In some embodiments, the backlight driving circuit further includes a switch control sub-circuit. The switch control sub-circuit is configured to provide a switch control signal to each of the control ends of the at least two switch sub-circuits, to connect the first ends and the second ends of the at least two switch sub-circuits in a time division manner.

In some embodiments, the light emitting element is a sub-millimeter light emitting diode or a micro light emitting diode.

In some embodiments, a duty ratio of the pulse width modulation signal is adjusted to control a turn-on time period of the switch module, to control brightness of light emitted by the light emitting element.

In another aspect, a backlight driving method is applied to the backlight driving circuit described above. A backlight driving period includes N driving stages sequentially, and N is an integer greater than 1, the backlight driving method includes: in an nth driving stage, connecting, by an nth switch sub-circuit included in the backlight driving circuit, a first end of the nth switch sub-circuit and a second end of the nth switch sub-circuit under the control of a switching control signal; other switch sub-circuits included in the backlight driving circuit disconnecting the first ends and the second ends of the other switch sub-circuits; and n is a positive integer less than or equal to N.

In some embodiments, the first electrode of the light emitting element is cathode, the second electrode of the light emitting element is anode, and the backlight driving method further includes: in the nth driving stage, an nth driving end of the backlight driving circuit inputting an nth turn-on voltage, and controlling, by the backlight driving sub-circuit, a corresponding voltage receiving end to receive a first voltage under the control of a corresponding pulse width modulation signal, the first voltage being less than the nth turn-on voltage.

In some embodiments, the first electrode of the light emitting element is anode, the second electrode of the light emitting element is cathode, and the backlight driving method further includes: in the nth driving stage, an nth driving end of the backlight driving circuit inputting an nth cathode voltage, and controlling, by the backlight driving sub-circuit, a corresponding voltage receiving end to receive a second voltage under the control of a corresponding pulse width modulation signal, the second voltage being greater than the nth cathode voltage.

In some embodiments, a duty ratio of the pulse width modulation signal is adjusted to control a time period of the corresponding voltage receiving end receiving the first voltage, to control brightness of light emitted by the light emitting element.

In some embodiments, a duty ratio of the pulse width modulation signal is adjusted to control a time period of the corresponding voltage receiving end receiving the second voltage, to control brightness of light emitted by the light emitting element.

In another aspect, a backlight driving module includes at least two backlight driving circuits described above.

In some embodiments, the backlight driving circuit includes a switch control sub-circuit, the backlight driving module comprises a micro control circuit, and the switch control sub-circuit is disposed in the micro control circuit; and the backlight driving sub-circuit comprises a backlight driving chip.

In another aspect, a backlight circuit includes the backlight driving module described above.

In some embodiments, the backlight driving module includes A backlight driving circuits; the backlight circuit further includes A light emitting units; each light emitting unit comprises M rows and N columns of light emitting elements; each light emitting unit corresponds to one backlight driving circuit; the backlight driving module comprises a micro control circuit; the micro control circuit includes M switch control signal output ends; the backlight driving sub-circuit includes N voltage receiving ends; and the backlight driving circuit includes M switch sub-circuits; M, N, and A are all integers greater than one; an mth switch control signal output end of the micro control circuit is connected to a control end of an mth switch sub-circuit in each backlight drive circuit, and the micro control circuit is configured to provide a switch control signal to the mth switch sub-circuit by the mth switch control signal output end; an nth voltage receiving end included in backlight driving sub-circuit of each backlight driving circuit is connected to first electrodes of all the light emitting elements located in the nth column of the corresponding light emitting unit; second electrodes of the light emitting elements in the mth row of each light emitting unit are connected to a first end of the mth switch sub-circuit in the corresponding backlight driving circuit; a second end of the mth switch sub-circuit is connected to the corresponding driving end; and m is a positive integer less than or equal to M, and n is a positive integer less than or equal to N.

In another aspect, a display device includes the backlight circuit described above.

DETAILED DESCRIPTION

Figure 1:
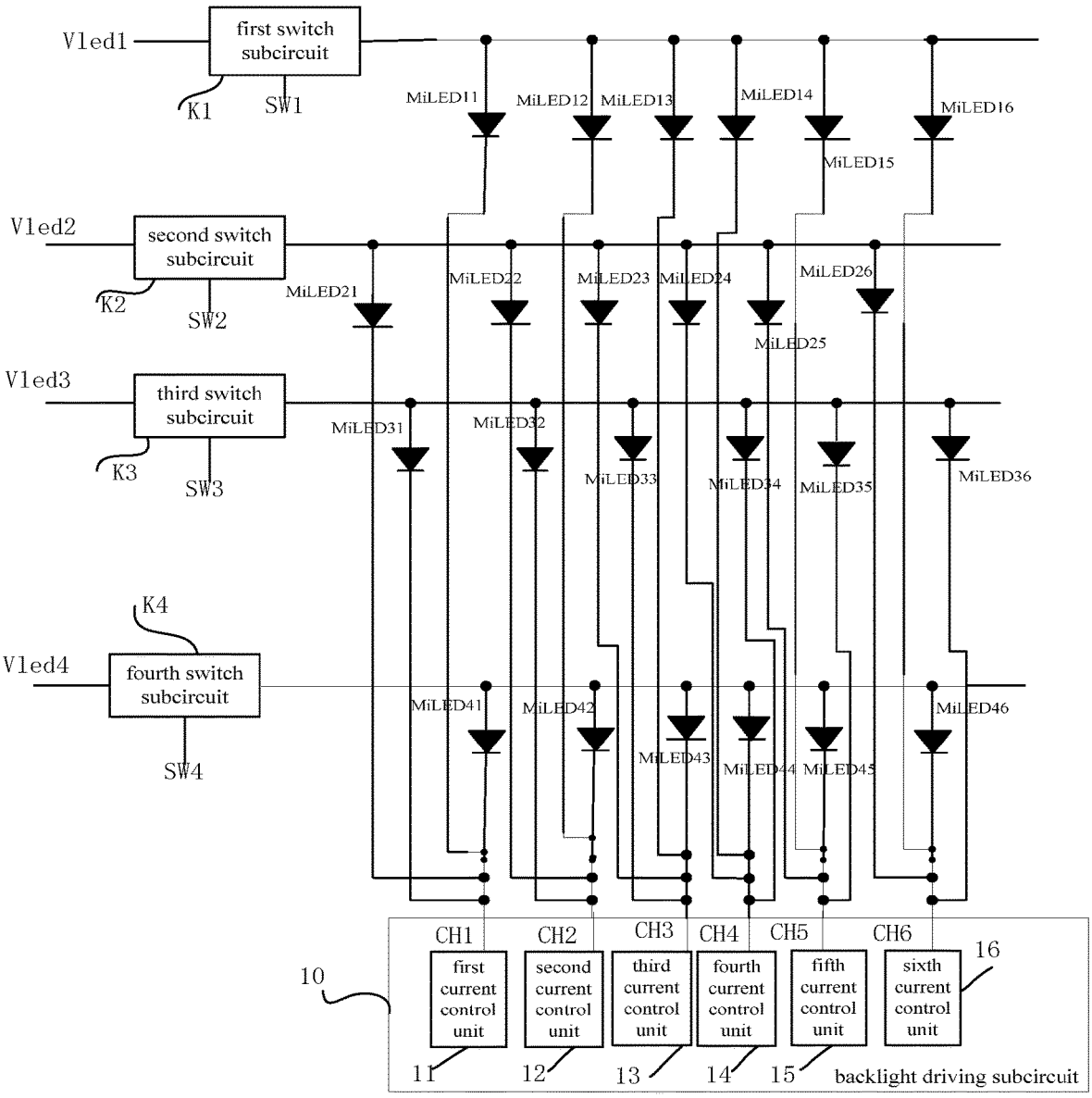
FIG. 1 is a schematic diagram of a backlight driving circuit according to at least one embodiment of the present disclosure.

The technical solutions in the embodiments of the present disclosure are clearly and completely described in the following with reference to the accompanying drawings. It is obvious that the described embodiments are only a part of the embodiments of the present disclosure, and not all of the embodiments. All other embodiments obtained by a person skilled in the art based on the embodiments of the present disclosure without are within the scope of the disclosure.

The transistors used in all embodiments of the present disclosure may be thin film transistors (TFTs) or field effect transistors or other devices having same characteristics. In the embodiments of the present disclosure, in order to distinguish the two electrodes of the transistor other than gate electrode, one of the two electrodes is referred to as a first electrode and the other is referred to as a second electrode. In an actual operation, the first electrode may be a drain electrode, and the second electrode may be a source electrode; or the first electrode may be a source electrode, and the second electrode may be a drain electrode.

The backlight driving circuit of some embodiments of the present disclosure includes at least two switch sub-circuits; at least two driving ends; and a backlight driving sub-circuit. The backlight driving sub-circuit includes at least one voltage receiving end. The voltage receiving end is connected to first electrodes of the at least two light emitting elements. Second electrodes of the at least two light emitting elements are connected to first ends of the at least two switch sub-circuits respectively. The control end of the switch sub-circuit receives a corresponding switch control signal, and the second end of the switch sub-circuit is connected to a corresponding driving end. The first end and the second end of the switch sub-circuit are connected or disconnected under the control of the switch control signal.

The backlight driving circuit of some embodiments of the present disclosure can realize time division multiplexing of voltage receiving ends of the backlight driving sub-circuit by using one backlight driving sub-circuit and a plurality of switch sub-circuits composed of discrete components, thereby enabling one backlight driving sub-circuit to control a plurality of partitions, reducing the quantity of required backlight driving sub-circuits, and reducing cost.

According to a specific embodiment, the light emitting element may be a mini LED (sub-millimeter light emitting diode) or a micro LED (micro-light emitting diode). A first electrode of the light emitting element is cathode, and a second electrode of the light emitting element is anode.

The driving end is configured to input a corresponding turn-on voltage, and the backlight driving sub-circuit is specifically configured to control a corresponding voltage receiving end to receive a first voltage under the control of a corresponding pulse width modulation signal. The first voltage is less than the turn-on voltage, and a voltage difference between the turn-on voltage and the first voltage is greater than a turn-on voltage of the corresponding light emitting element, so as to enable the light emitting element to emit light.

In actual operation, the first voltage is inputted by a first voltage input end, and the first voltage input end is disposed in the backlight driving sub-circuit.

When the switch sub-circuit controls the anode of the light emitting element to receive the turn-on voltage, the backlight driving sub-circuit controls the voltage receiving end to receiving the first voltage under the control of the corresponding pulse width modulation signal, so as to enable the light emitting element to emit light.

Specifically, when the pulse width modulation signal is valid, the backlight driving sub-circuit controls the corresponding voltage receiving end to receive the corresponding first voltage, so as to enable the light emitting element to emit light. At this time, a backlight driving current of the light emitting element flows from an anode of the light emitting element to a cathode of the light emitting element. When the pulse width modulation signal is invalid, the backlight driving sub circuit controls a corresponding voltage receiving end to be suspended to control the light emitting element not to emit light. In some embodiments of the present disclosure, the light emitting luminance of the light emitting element is controlled by adjusting the duty ratio of the pulse width modulation signal.

In a specific implementation, the backlight driving sub-circuit may further include at least one current control unit, and the current control unit is connected to a corresponding voltage receiving end. The current control unit includes a switch module and a current control module. A first end of the switch module is connected to a corresponding voltage receiving end, a second end of the switch module is connected to a corresponding first voltage input end, and a control end of the switch module receives a corresponding pulse width modulation signal. The corresponding voltage receiving end and the corresponding first voltage input end are connected or disconnected by the switch module under the control of the pulse width modulation signal. The first voltage input end is configured to input the first voltage.

The current control module is connected to the corresponding driving end, and is configured to, when the corresponding voltage input end and the corresponding first voltage input end are connected by the switch module, adjust the turn-on voltage from the driving end, so as to adjust a current value of a backlight driving current flowing through the corresponding light emitting element to a corresponding predetermined current value.

Specifically, the predetermined current value may be selected according to actual conditions.

In actual operation, each voltage receiving end of the backlight driving sub-circuit corresponds to a current control unit corresponding to an LED (Light Emitting Diode) channel. For example, the current control unit corresponding to one of the voltage receiving ends may include a current control module and a switch module, and when the corresponding voltage receiving end and the corresponding first voltage input end are connected by the switch module, the current control module adjust the current value of the backlight driving current flowing through the corresponding light emitting element to a predetermined current value by adjusting the turn on voltage from the corresponding driving end. The control end of the switch module receives a corresponding pulse width modulation signal, and adjusts the turn-on time period of the switch module by adjusting the duty ratio of the pulse width modulation signal, thereby adjusting the time period of the voltage receiving end receiving the corresponding first voltage, so as to control the brightness of the light emitted by the corresponding light emitting element.

In an implementation, when the pulse width modulation signal is valid, the switch module is turned on to control the connection between the corresponding first voltage input end and the corresponding voltage receiving end. When the pulse width modulation signal is invalid, the switch module is turned off to control disconnection between the corresponding first voltage input end and the corresponding voltage receiving end.

According to another implement, the light emitting element may be a mini LED (sub-millimeter light emitting diode) or a micro LED (micro light emitting diode).

The first electrode of the light emitting element is anode and the second electrode of the light emitting element is cathode. The driving end is configured to input a corresponding cathode voltage, and the backlight driving sub-circuit is specifically configured to determine whether the corresponding second voltage is received through the corresponding voltage receiving end under the control of the corresponding pulse width modulation signal. The second voltage is greater than the cathode voltage, and a voltage difference between the second voltage and the cathode voltage is greater than a turn-on voltage of the corresponding light emitting element to enable the corresponding light emitting element to emit light.

In actual operation, the second voltage is inputted by a second voltage input end, and the second voltage input end is disposed in the backlight driving sub-circuit.

When the switch sub-circuit controls the cathode of the light emitting element to receive the cathode voltage, the backlight driving sub-circuit controls the voltage receiving end to receive the second voltage under the control of a corresponding PMW signal, so as to enable the light emitting element to emit light.

Specifically, when the pulse width modulation signal is valid, the backlight driving sub-circuit controls the corresponding voltage receiving end to receive the second voltage, so as to enable the light emitting element to emit light. At this time, the backlight driving current of the light emitting element flows from an anode to a cathode of the light emitting element. When the pulse width modulation signal is invalid, the backlight driving sub circuit controls a corresponding voltage receiving end to be suspended to control the light emitting element not to emit light. In some embodiments of the present disclosure, the brightness of the light emitting elements is controlled by adjusting the duty cycle of the pulse width modulation signal.

In an implementation, the backlight driving sub-circuit further includes at least one current control unit, and the current control unit corresponds to the voltage receiving end. The current control unit includes a switch module and a current control module. The first end of the switch module is connected to the corresponding voltage receiving end, the second end of the switch module is connected to a corresponding second voltage input end, and the control end of the switch module receives the corresponding a pulse width modulation signal. The switch module is configured to turn on or off a connection between the corresponding voltage receiving end and a corresponding second voltage input end under the control of the pulse width modulation signal. The second voltage input end is configured to input the second voltage.

The current control module is connected to the corresponding driving end, and is configured to adjust a current value of a backlight driving current flowing through the corresponding light emitting element to a predetermined current value by adjusting the cathode voltage from the driving end when the switch module connects the corresponding voltage receiving end and the corresponding second voltage input end.

Specifically, the predetermined current value may be selected according to actual conditions.

In actual operation, each voltage receiving end of the backlight driving sub-circuit corresponds to a current control unit corresponding to an LED channel. For example, the current control unit corresponding to one of the voltage receiving ends may include a current control module and a switch module, and when the switch module connects the corresponding voltage receiving end and the corresponding second voltage input end, the current control module adjusts the current value of the backlight driving current flowing through the corresponding light emitting element to a predetermined current value by adjusting the corresponding cathode voltage. The control end of the switch module receives the corresponding pulse width modulation signal, and adjusts the turn on time period of the switch module by adjusting the duty ratio of the pulse width modulation signal, thereby adjusting the time period the voltage receiving end receiving the second voltages, so as to control the brightness of the light emitted by the corresponding light emitting element.

In an implementation, when the pulse width modulation signal is valid, the switch module is turned on to connect the corresponding second voltage input end and the corresponding voltage receiving end. When the pulse width modulation signal is invalid, the switch module is turned off to disconnect the corresponding second voltage input end and the corresponding voltage receiving end.

Specifically, the backlight driving sub-circuit may be a backlight driving chip, but is not limited thereto.

The backlight driving circuit of the present disclosure is described below by using some embodiments. In some embodiments, the first electrode is cathode, the second electrode is anode, the light emitting element is a sub-millimeter light emitting diode, and the backlight driving circuit includes four switch sub-circuits (for example only, in actual operation, the number of switch sub-circuits included in the backlight drive circuit may be any integer greater than 1), and the backlight driving sub-circuit includes six voltage receiving ends (for example only, in the actual operation, when the backlight driving sub-circuit is a backlight driving chip, the backlight driving chip may include six voltage receiving ends, but not limited thereto, the number of voltage receiving ends included in the backlight driving circuit may be any integer greater than one).

As shown in FIG. 1, a backlight driving circuit of some embodiments of the present disclosure includes a backlight driving sub-circuit 10, and the backlight driving sub-circuit 10 includes six voltage receiving ends: a first voltage receiving end CH1, a second voltage receiving end CH2, a third voltage receiving end CH3, a fourth voltage receiving end CH4, a fifth voltage receiving end CH5, and a sixth voltage receiving end CH6.

The backlight driving sub-circuit 10 further includes a first current control unit 11, a second current control unit 12, a third current control unit 13, a fourth current control unit 14, a fifth current control unit 15, and a sixth current control unit 16.

CH1 corresponds to the first current control unit 11, CH2 corresponds to the second current control unit 12, CH3 corresponds to the third current control unit 13, CH4 corresponds to the fourth current control unit 14, CH5 corresponds the fifth current control unit 15, and CH6 corresponds to the sixth current control unit 16.

The backlight driving circuit further includes four switch sub-circuits: a first switch sub-circuit K1, a second switch sub-circuit K2, a third switch sub-circuit K3, and a fourth switch sub-circuit K4.

The first voltage receiving end CH1 is connected to the cathode of the first millimeter light emitting diode MiLED11, the cathode of the second millimeter light emitting diode MiLED21, the cathode of the third millimeter light emitting diode MiLED31, and the cathode of the fourth millimeter light emitting diode MiLED41.

The anode of the MiLED 11 is connected to the first end of the first switch sub-circuit K1; the anode of the MiLED 21 is connected to the first end of the second switch sub-circuit K2; the anode of the MiLED 31 is connected to the first end of the third switch sub-circuit K3; the anode of the MiLED 41 is connected to the first end of the fourth switch sub-circuit K4.

The control end of K1 is connected to the first switch control signal SW1, the control end of K2 is connected to the second switch control signal SW2, the control end of K3 is connected to the third switch control signal SW3, and the control end of K4 is connected to the fourth switch control signal SW4.

The second end of the K1 is connected to the first driving end, the second end of the K2 is connected to the second driving end, the second end of the K3 is connected to the third driving end, and the second end of the K4 is connected to the fourth driving end. The first driving end is used for inputting a first turn-on voltage Vled1, the second driving end is used for inputting a second turn-on voltage Vled2, the third driving end is used for inputting a third turn-on voltage Vled3, and the fourth driving end is used for inputting a fourth turn-on voltage Vled4.

The second voltage receiving end CH2 is connected to the cathode of the fifth millimeter light emitting diode MiLED12, the cathode of the sixth millimeter light emitting diode MiLED22, the cathode of the seventh millimeter light emitting diode MiLED32, and the cathode of the eighth millimeter light emitting diode MiLED42.

The anode of the MiLED 12 is connected to the first end of the first switch sub-circuit K1; the anode of the MiLED 22 is connected to the first end of the second switch sub-circuit K2; the anode of the MiLED 32 is connected to the first end of the third switch sub-circuit K3; the anode of the MiLED 42 is connected to the first end of the fourth switch sub-circuit K4.

The third voltage receiving end CH3 is connected to the cathode of the ninth millimeter light emitting diode MiLED13, the cathode of the tenth millimeter light emitting diode MiLED23, the cathode of the eleventh millimeter light emitting diode MiLED33, and the cathode of the twelfth millimeter light emitting diode MiLED43.

The anode of the MiLED 13 is connected to the first end of the first switch sub-circuit K1; the anode of the MiLED 23 is connected to the first end of the second switch sub-circuit K2; the anode of the MiLED 33 is connected to the first end of the third switch sub-circuit K3; the anode of the MiLED 43 is connected to the first end of the fourth switch sub-circuit K4.

The fourth voltage receiving end CH4 is connected to the cathode of the thirteenth millimeter light emitting diode MiLED14, the cathode of the fourteenth millimeter light emitting diode MiLED24, the cathode of the fifteenth millimeter light emitting diode MiLED34, and the cathode of the sixteenth millimeter light emitting diode MiLED44.

The anode of the MiLED 14 is connected to the first end of the first switch sub-circuit K1; the anode of the MiLED 24 is connected to the first end of the second switch sub-circuit K2; the anode of the MiLED 34 is connected to the first end of the third switch sub-circuit K3; the anode of the MiLED 44 is connected to the first end of the fourth switch sub-circuit K4.

The fifth voltage receiving end CH5 is connected to the cathode of the seventeenth millimeter light emitting diode MiLED15, the cathode of the eighteenth millimeter light emitting diode MiLED25, the cathode of the nineteenth millimeter light emitting diode MiLED35, and the cathode of the twentieth millimeter light emitting diode MiLED45.

The anode of the MiLED 15 is connected to the first end of the first switch sub-circuit K1; the anode of the MiLED 25 is connected to the first end of the second switch sub-circuit K2; the anode of the MiLED 35 is connected to the first end of the third switch sub-circuit K3; the anode of the MiLED 45 is connected to the first end of the fourth switch sub-circuit K4.

The sixth voltage receiving end CH6 is connected to the cathode of the twenty-first millimeter light emitting diode MiLED16, the cathode of the twenty-second millimeter light emitting diode MiLED26, the cathode of the twenty-third millimeter light emitting diode MiLED36, and the cathode of the twenty-fourth millimeter light emitting diode MiLED46.

The anode of the MiLED 16 is connected to the first end of the first switch sub-circuit K1; the anode of the MiLED 26 is connected to the first end of the second switch sub-circuit K2; the anode of the MiLED 36 is connected to the first end of the third switch sub-circuit K3; the anode of the MiLED 46 is connected to the first end of the fourth switch sub-circuit K4.

Figure 2:
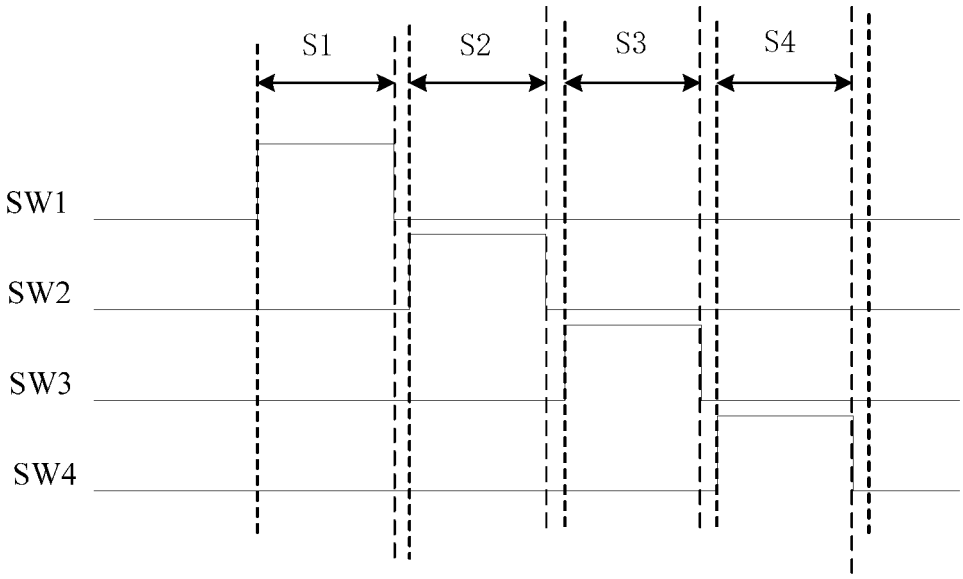
FIG. 2 is a time sequence diagram of a backlight driving circuit according to at least one embodiment of the present disclosure.

As shown in FIG. 2, in some embodiments of the backlight driving circuit shown in FIG. 1 of the present disclosure, a backlight driving cycle includes a first driving stage S1, a second driving stage S2, and a third driving stage S3 and a fourth driving stage S4 sequentially.

In the first driving stage S1, SW1 is at a high level, SW2, SW3 and SW4 are all at a low level, K1 is turned on, K2, K3 and K4 are all turned off, so that Vled1 is written into the anode of MiLED11, the anode of MiLED12, the anode of the MiLED 13, the anode of the MiLED 14, the anode of the MiLED 15, and the anode of the MiLED 16. The first current control unit 11 controls CH1 to receive the low voltage under the control of the first pulse width modulation signal corresponding to CH1, to generate a backlight driving current for driving the MiLED 11; the second current control unit 12 controls CH2 to receive a low voltage under control of a second pulse width modulation signal corresponding to CH2, to generate a backlight driving current for driving the MiLED 12; the third current control unit 13 controls CH3 to receive a low voltage under control of a third pulse width modulation signal corresponding to CH3, to generate a backlight driving current for driving the MiLED 13; the fourth current control unit 14 controls CH4 to receive the low voltage under the control of the fourth pulse width modulation signal corresponding to CH4, to generate the backlight driving current for driving the MiLED 14; the fifth current control unit 15 controls CH5 to receive the low voltage under the control of the fifth pulse width modulation signal corresponding to CH5, to generate the backlight driving current for driving the MiLED 15; the sixth current control unit 16 controls CH6 to receive the low voltage under the control of the sixth pulse width modulation signal corresponding to CH6, to generate the backlight driving current for driving the MiLED 16, so that MiLED11, MiLED12, MiLED13, MiLED 14, MiLED 15, and MiLED 16 respectively emit light in respective time periods, and the first current control unit 11 adjusts Vled1 so that the current value of the backlight driving current flowing through the MiLED 11 is a predetermined current value when MiLED 11 emits light; the second current control unit 12 adjusts Vled1 so that the current value of the backlight driving current flowing through the MiLED 12 is a predetermined current value when MiLED 12 emits light; the third current control unit 13 adjusts Vled1 so that the current value of the backlight driving current flowing through the MiLED 13 is a predetermined current value when MiLED 13 emits light; the fourth current control unit 14 adjusts Vled1 so that the current value of the backlight driving current flowing through the MiLED 14 is a predetermined current value when MiLED 14 emits light; the fifth current control unit 15 adjusts Vled1 so that the current value of the backlight driving current flowing through the MiLED 15 is a predetermined current value when MiLED 15 emits light; the sixth current control unit 16 adjusts Vled1 so that the current value of the backlight driving current flowing through the MiLED 16 is a predetermined current value when MiLED 16 emits light, other MiLEDs do not emit light.

In the second driving stage S2, SW2 is at a high level, SW1, SW3 and SW4 are all at a low level, K2 is turned on, K1, K3 and K4 are all turned off, so that Vled1 is written into the anode of MiLED21, the anode of MiLED22, the anode of the MiLED 23, the anode of the MiLED 24, the anode of the MiLED 25, and the anode of the MiLED 26. The first current control unit 11 controls CH1 to receive the low voltage under the control of the first pulse width modulation signal corresponding to CH1, to generate a backlight driving current for driving the MiLED 21; the second current control unit 12 controls CH2 to receive a low voltage under control of a second pulse width modulation signal corresponding to CH2, to generate a backlight driving current for driving the MiLED 22; the third current control unit 13 controls CH3 to receive a low voltage under control of a third pulse width modulation signal corresponding to CH3, to generate a backlight driving current for driving the MiLED 23; the fourth current control unit 14 controls CH4 to receive the low voltage under the control of the fourth pulse width modulation signal corresponding to CH4, to generate the backlight driving current for driving the MiLED 24; the fifth current control unit 15 controls CH5 to receive the low voltage under the control of the fifth pulse width modulation signal corresponding to CH5, to generate the backlight driving current for driving the MiLED 25; the sixth current control unit 16 controls CH6 to receive the low voltage under the control of the sixth pulse width modulation signal corresponding to CH6, to generate the backlight driving current for driving the MiLED 26, so that MiLED21, MiLED22, MiLED23, MiLED 24, MiLED 25, and MiLED 26 respectively emit light in respective time periods, and the first current control unit 11 adjusts Vled1 so that the current value of the backlight driving current flowing through the MiLED 21 is a predetermined current value when MiLED 21 emits light; the second current control unit 12 adjusts Vled1 so that the current value of the backlight driving current flowing through the MiLED 22 is a predetermined current value when MiLED 22 emits light; the third current control unit 13 adjusts Vled1 so that the current value of the backlight driving current flowing through the MiLED 23 is a predetermined current value when MiLED 23 emits light; the fourth current control unit 14 adjusts Vled1 so that the current value of the backlight driving current flowing through the MiLED 24 is a predetermined current value when MiLED 24 emits light; the fifth current control unit 15 adjusts Vled1 so that the current value of the backlight driving current flowing through the MiLED 25 is a predetermined current value when MiLED 25 emits light; the sixth current control unit 16 adjusts Vled1 so that the current value of the backlight driving current flowing through the MiLED 26 is a predetermined current value when MiLED 26 emits light, other MiLEDs do not emit light.

In the third driving stage S3, SW3 is at a high level, SW1, SW2 and SW4 are all at a low level, K3 is turned on, K1, K2 and K4 are all turned off, so that Vled1 is written into the anode of MiLED31, the anode of MiLED32, the anode of the MiLED 33, the anode of the MiLED 34, the anode of the MiLED 35, and the anode of the MiLED 36. The first current control unit 11 controls CH1 to receive the low voltage under the control of the first pulse width modulation signal corresponding to CH1, to generate a backlight driving current for driving the MiLED 31; the second current control unit 12 controls CH2 to receive a low voltage under control of a second pulse width modulation signal corresponding to CH2, to generate a backlight driving current for driving the MiLED 32; the third current control unit 13 controls CH3 to receive a low voltage under control of a third pulse width modulation signal corresponding to CH3, to generate a backlight driving current for driving the MiLED 33; the fourth current control unit 14 controls CH4 to receive the low voltage under the control of the fourth pulse width modulation signal corresponding to CH4, to generate the backlight driving current for driving the MiLED 34; the fifth current control unit 15 controls CH5 to receive the low voltage under the control of the fifth pulse width modulation signal corresponding to CH5, to generate the backlight driving current for driving the MiLED 35; the sixth current control unit 16 controls CH6 to receive the low voltage under the control of the sixth pulse width modulation signal corresponding to CH6, to generate the backlight driving current for driving the MiLED 36, so that MiLED31, MiLED32, MiLED33, MiLED 34, MiLED 35, and MiLED 36 respectively emit light in respective time periods, and the first current control unit 11 adjusts Vled1 so that the current value of the backlight driving current flowing through the MiLED 31 is a predetermined current value when MiLED 31 emits light; the second current control unit 12 adjusts Vled1 so that the current value of the backlight driving current flowing through the MiLED 32 is a predetermined current value when MiLED 32 emits light; the third current control unit 13 adjusts Vled1 so that the current value of the backlight driving current flowing through the MiLED 33 is a predetermined current value when MiLED 33 emits light; the fourth current control unit 14 adjusts Vled1 so that the current value of the backlight driving current flowing through the MiLED 34 is a predetermined current value when MiLED 34 emits light; the fifth current control unit 15 adjusts Vled1 so that the current value of the backlight driving current flowing through the MiLED 35 is a predetermined current value when MiLED 35 emits light; the sixth current control unit 16 adjusts Vled1 so that the current value of the backlight driving current flowing through the MiLED 36 is a predetermined current value when MiLED 36 emits light, other MiLEDs do not emit light.

In the fourth driving stage S4, SW4 is at a high level, SW1, SW2 and SW3 are all at a low level, K4 is turned on, K1, K2 and K3 are all turned off, so that Vled1 is written into the anode of MiLED41, the anode of MiLED42, the anode of the MiLED 43, the anode of the MiLED 44, the anode of the MiLED 45, and the anode of the MiLED 46. The first current control unit 11 controls CH1 to receive the low voltage under the control of the first pulse width modulation signal corresponding to CH1, to generate a backlight driving current for driving the MiLED 41; the second current control unit 12 controls CH2 to receive a low voltage under control of a second pulse width modulation signal corresponding to CH2, to generate a backlight driving current for driving the MiLED 42; the third current control unit 13 controls CH3 to receive a low voltage under control of a third pulse width modulation signal corresponding to CH3, to generate a backlight driving current for driving the MiLED 43; the fourth current control unit 14 controls CH4 to receive the low voltage under the control of the fourth pulse width modulation signal corresponding to CH4, to generate the backlight driving current for driving the MiLED 44; the fifth current control unit 15 controls CH5 to receive the low voltage under the control of the fifth pulse width modulation signal corresponding to CH5, to generate the backlight driving current for driving the MiLED 45; the sixth current control unit 16 controls CH6 to receive the low voltage under the control of the sixth pulse width modulation signal corresponding to CH6, to generate the backlight driving current for driving the MiLED 46, so that MiLED41, MiLED42, MiLED43, MiLED 44, MiLED 45, and MiLED 46 respectively emit light in respective time periods, and the first current control unit 11 adjusts Vled1 so that the current value of the backlight driving current flowing through the MiLED 41 is a predetermined current value when MiLED 41 emits light; the second current control unit 12 adjusts Vled1 so that the current value of the backlight driving current flowing through the MiLED 42 is a predetermined current value when MiLED 42 emits light; the third current control unit 13 adjusts Vled1 so that the current value of the backlight driving current flowing through the MiLED 43 is a predetermined current value when MiLED 43 emits light; the fourth current control unit 14 adjusts Vled1 so that the current value of the backlight driving current flowing through the MiLED 44 is a predetermined current value when MiLED 44 emits light; the fifth current control unit 15 adjusts Vled1 so that the current value of the backlight driving current flowing through the MiLED 45 is a predetermined current value when MiLED 45 emits light; the sixth current control unit 16 adjusts Vled1 so that the current value of the backlight driving current flowing through the MiLED 46 is a predetermined current value when MiLED 46 emits light, other MiLEDs do not emit light.

In the embodiment of the backlight driving circuit shown in FIG. 1, SW1, SW2, SW3, and SW4 are valid at a high level, but in actual operation, each switch control signal can also be valid at a low level. Two specific embodiments of the switch sub-circuit are described with the drawings.

As shown in FIG. 2, in order to ensure that there is no overlap between the respective driving stages, an interval period is set between adjacent driving periods.

Figure 3A:
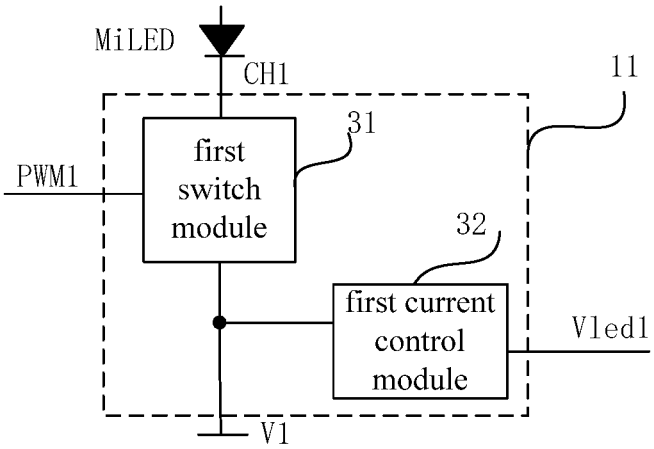
FIG. 3A is a schematic diagram of a first current control unit of the backlight driving circuit according to at least one embodiment of the present disclosure.

As shown in FIG. 3A, in the embodiment of the backlight driving circuit shown in FIG. 1, the first current control unit 11 corresponding to the first voltage receiving end CH1 may include a first switch module 31 and a first current control module 32.

The first end of the first switch module 31 is connected to the first voltage receiving end CH1, and the second end of the first switch module 31 is connected to the first voltage input end, and the control end of the first switch module 31 is connected to the corresponding first pulse width modulation signal pulse width modulation1; the first switch module 31 is configured to connect or disconnect the first voltage receiving end CH1 and the first voltage input end under the control of the first pulse width modulation signal pulse width modulation1; the first voltage input end is configured to input the first voltage V1.

The first current control module 32 is configured to adjust the first turn-on voltage Vled1, so as to adjust a current value of a current flowing through the corresponding light emitting element to a predetermined current value when the first switch module 31 connects the corresponding first voltage receiving end CH1 and the first voltage input end.

In actual operation, when the first switch module 31 connects CH1 and the first voltage input end, the first current control module 32 firstly detects the backlight driving current flowing through the first switch module in an on-state, compares the current value of the backlight driving current with a predetermined current value, and adjusts the first turn-on voltage Vled1 according to the comparison result.

Specifically, the predetermined current value may be selected according to actual conditions.

In actual operation, the first voltage V1 may be a low voltage, and the voltage values of the first voltage V1 corresponding to different voltage receiving ends of a same backlight driving sub-circuit may be different from each other, but not limited thereto.

Figure 3B:
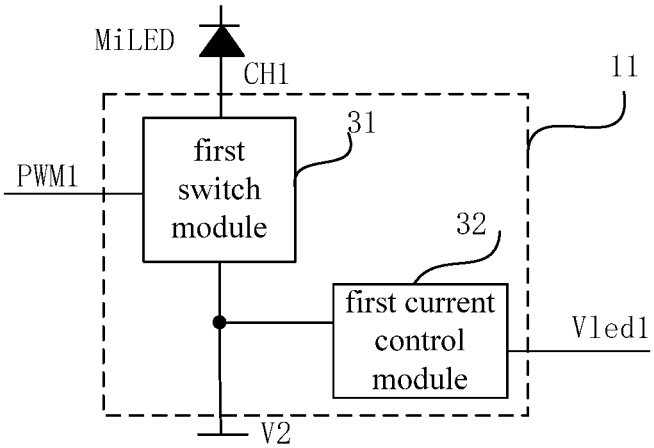
FIG. 3B is another schematic diagram of a first current control unit of the backlight driving circuit according to at least one embodiment of the present disclosure.

In other embodiments, as shown in FIG. 3B, the first end of the first switch module 31 is connected to the first voltage receiving end CH1, and the second end of the first switch module 31 is connected to the second voltage input end, and the control end of the first switch module 31 receives the corresponding first pulse width modulation signal pulse width modulation1. The first switch module 31 is configured to connect or disconnect the first voltage receiving end CH1 and the second voltage input end under the control of the first pulse width modulation signal pulse width modulation1. The second voltage input end is configured to input the second voltage V2. The backlight driving sub-circuit controls a corresponding voltage receiving end to receive a corresponding second voltage under control of a corresponding pulse width modulation signal. The second voltage is greater than the cathode voltage, and a voltage difference between the second voltage and the cathode voltage is greater than the turn-on voltage of the light emitting element, thereby enabling the MiLED to emit light.

The specific structure of the first current control unit corresponding to the first voltage receiving end CH1 is described above with reference to FIG. 3A. The structures of the other current control units included in the backlight driving circuit may be the same as the first current control unit as shown in FIG. 3A. Other current control units have corresponding connection relationships as the first current control unit.

Figure 4A:
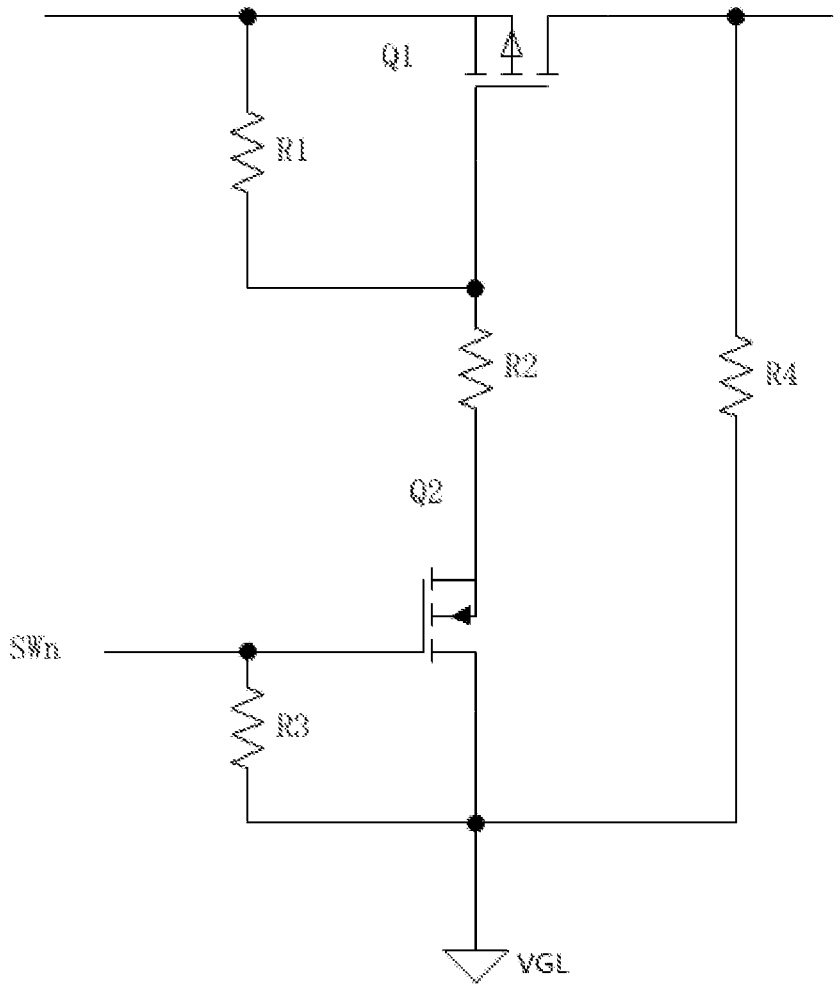
FIG. 4A is a schematic diagram of a switch sub-circuit of the backlight driving circuit according to one embodiment of the present disclosure.

As shown in FIG. 4A, the first embodiment of the switch sub-circuit may include a first switching transistor Q1, a second switching transistor Q2, a first resistor R1, a second resistor R2, a third resistor R3, and a fourth resistor R4. A gate electrode of the second switching transistor Q2 is a control end of the switch sub-circuit, and a drain electrode of the second switching transistor Q2 is connected to a gate electrode of the first switching transistor Q1 through the second resistor R2. The source electrode of the second switching transistor Q2 is connected to the low level input end; the low level input end is used to input a low level VGL; the gate electrode of the Q2 receives a corresponding switch control signal SWn.

The drain electrode of the first switching transistor Q1 is the first end of the switch sub-circuit, and the source electrode of the first switching transistor Q1 is the second end of the switch sub-circuit. The first resistor R1 is connected between the drain electrode of the first switching transistor Q1 and the gate electrode of the first switching transistor Q1, and the third resistor R3 is connected to the gate electrode of the second switching transistor Q2 and the low level input end. The fourth resistor R4 is connected between the source electrode of the first switching transistor Q1 and the low level input end. The first switching transistor Q1 is a p-type transistor, and the second switching transistor Q2 is an n-type transistor.

When the switch sub-circuit shown in FIG. 4A is in operation, SWn is at a high level, Q2 is turned on, so that the gate electrode of Q1 receives a low level VGL, and Q1 is turned on to connect the first end of the switch sub-circuit and the second end of the switch sub-circuit. When SWn is low, Q2 is turned off to disconnect the low-level input end and Q1, and Q1 is turned off to disconnect the first end of the switch sub-circuit and the second end of the switch sub-circuit.

In the first embodiment of the switch sub-circuit shown in FIG. 4A, R1 is used to prevent Q1 from being electrostatically broken down; R2 is used for current limiting protection, and R3 is used for ESD (Electro-Static discharge) protect and ensures that the gate electrode of Q2 can be effectively turned off when it is connected to a low level. R4 is used to discharge potential of the source electrode of Q1 when Q1 is turned off.

Figure 4B:
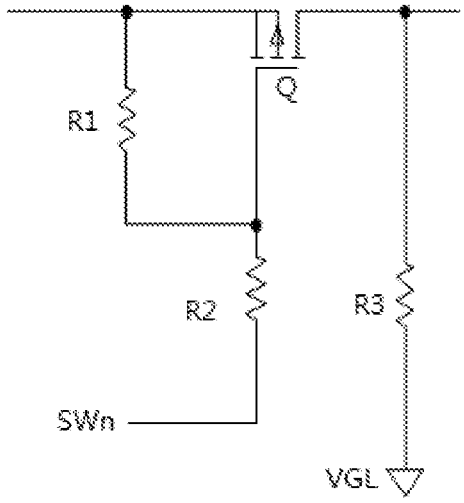
FIG. 4B is another schematic diagram of a switch sub-circuit of the backlight driving circuit according to one embodiment of the present disclosure.

As shown in FIG. 4B, the second embodiment of the switch sub-circuit may include a switching transistor Q, a first resistor R1, a second resistor R2, and a third resistor R3. A gate electrode of the switching transistor Q is connected to a first end of the second resistor R2, a drain electrode of the switching transistor Q is a first end of the switch sub-circuit, and a source electrode of the switching transistor Q is a second end of the switch sub-circuit. The second end of the second resistor R2 is the control end of the switch sub-circuit; the second end of R2 receives the corresponding switch control signal SWn. The first resistor R1 is connected between the gate electrode of the switching transistor Q and the drain electrode of the switching transistor Q, and the third resistor R3 is connected between to the source electrode of the switching transistor Q and the low level input end. The low level input end is used to input a low level VGL. The switching transistor Q is a p-type transistor.

When the switch sub-circuit shown in FIG. 4B is in operation, SWn is at a low level, Q is turned on to connect the first end and the second end of the switch sub-circuit. When SWn is at a high level, Q is turned off to disconnect the first end of the switch sub-circuit and the second end of the switch sub-circuit.

In the second embodiment of the switch sub-circuit shown in FIG. 4B, R1 is used to prevent Q from being electrostatically broken down; R2 is used for current limiting protection, and R3 is used to discharge potential of the source electrode of Q when Q is turned off.

In an implementation, the backlight driving circuit of some embodiments of the present disclosure may further include a switch control sub-circuit. The switch control sub-circuit is configured to provide a corresponding switch control signal to the control ends of the at least two switch sub-circuits, so that at least two switch sub-circuits to connect the first end and the second end of the switch sub-circuit in a time division manner.

In actual operation, the switch control sub-circuit may be disposed in an MCU (Micro Controller Unit) for providing a switch control signal.

Figure 5:
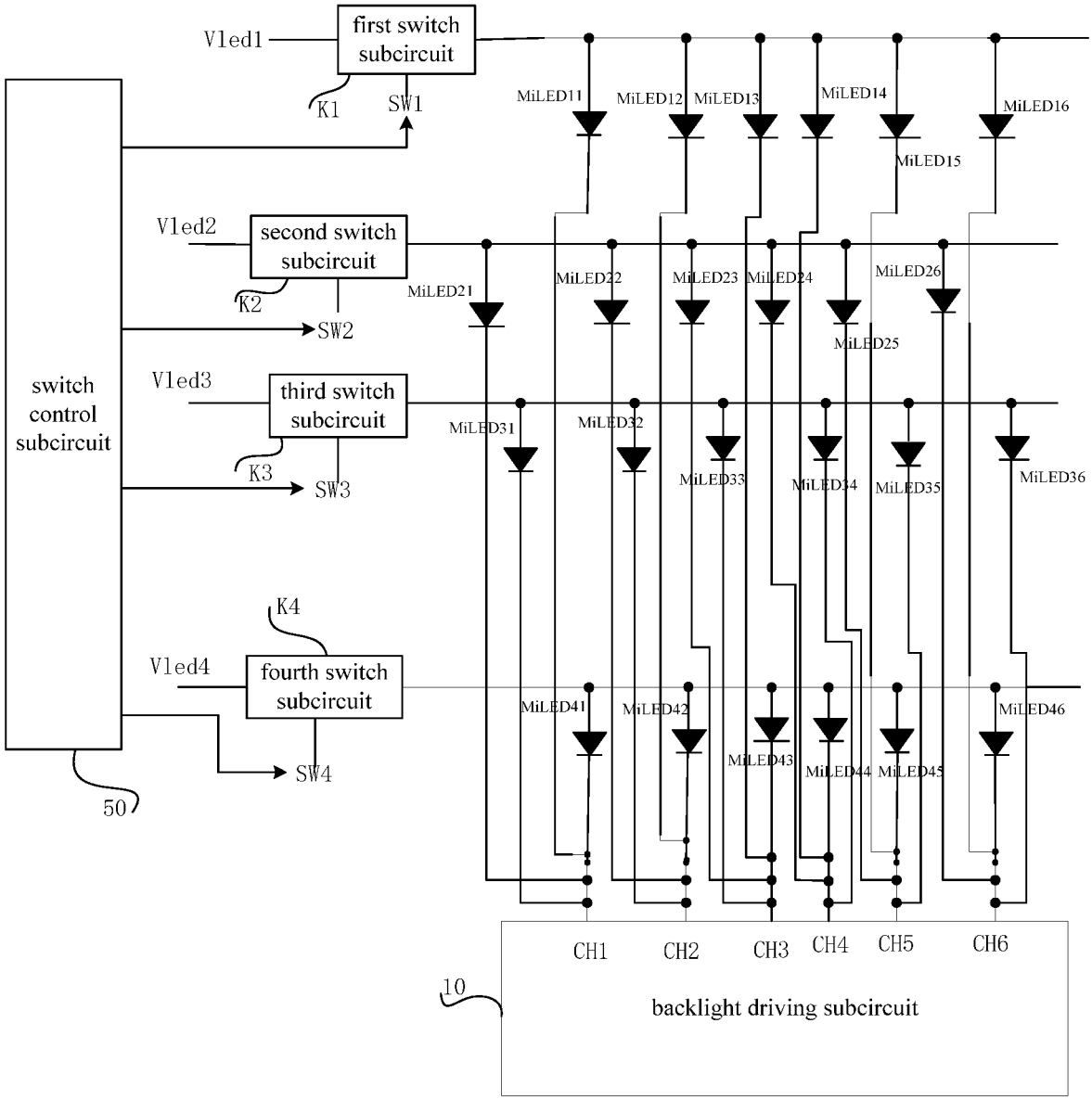
FIG. 5 is a schematic diagram of a backlight driving circuit according to at least one embodiment of the present disclosure.

As shown in FIG. 5, the backlight drive circuit further includes a switch control sub-circuit 50. The switch control sub-circuit 50 is configured to provide a first switch control signal SW1 for the control end of the first switch sub-circuit K1, a second switch control signal SW2 for the control end of the second switch sub-circuit K2, a third switch control signal SW3 for the control end of the third switch sub-circuit K3, and a fourth switch control signal SW4 for the control end of the fourth switch sub-circuit K4, so as to turn on K1, K2, K3 and K4 in a time division manner.

A backlight driving method of some embodiments of the present disclosure is applied to the backlight driving circuit described above. A backlight driving period includes N driving stages sequentially, and N is an integer greater than 1. The backlight driving method includes: in the nth driving stage, connecting, by the nth switch sub-circuit included in the backlight driving circuit, the first end of the nth switch sub-circuit and the second end of the nth switch sub-circuit under the control of a corresponding switching control signal; each of other switch sub-circuits included in the backlight driving circuit disconnects the first end and the second end of the other switch sub-circuit; n is a positive integer less than or equal to N.

In a specific implementation, respective switch sub-circuits need to be turned on in a time division manner to control the brightness of each of the light emitting elements.

The backlight driving method according to some embodiments of the present disclosure can realize time division multiplexing of the voltage receiving ends of the backlight driving sub-circuit by using a backlight driving sub-circuit and a plurality of switch sub-circuits composed of discrete devices, thereby enabling one backlight driving sub-circuit to control multiple partitions, reducing the number of backlight driving sub-circuits, and reducing cost.

According to some embodiments, the light emitting element may be a sub-millimeter light emitting diode or a micro light emitting diode; the first electrode of the light emitting element is cathode, the second electrode of the light emitting element is anode, and the backlight driving method may further include: in the nth driving stage, the nth driving end of the backlight driving circuit inputting an nth turn-on voltage, and controlling, by the backlight driving sub-circuit, the corresponding voltage receiving end to receive the first voltage under the control of the corresponding pulse width modulation signal. The first voltage is less than the nth turn-on voltage.

According to another embodiment, the light emitting element may be a sub-millimeter light emitting diode or a micro light emitting diode; the first electrode of the light emitting element is anode, the second electrode of the light emitting element is cathode, and the backlight driving method may also include: in the nth driving stage, the nth driving end of the backlight driving circuit inputting an nth cathode voltage, and controlling, by the backlight driving sub-circuit, a corresponding voltage receiving end to receive a second voltage under the control of a corresponding pulse width modulation signal. The second voltage is greater than the nth cathode voltage.

The backlight driving module includes at least two backlight driving circuits described above.

Specifically, the backlight driving circuit includes a switch control sub-circuit. The backlight driving module includes a micro control circuit, and the switch control sub-circuit is disposed in the micro control circuit. The backlight driving sub-circuit includes a backlight driving chip.

According to an implementation, the backlight driving module includes at least two backlight driving circuits, and the at least two backlight driving circuits may include one switch control sub-circuit, and the switch control sub-circuit provides a corresponding switch control signal for the switch sub-circuit in the at least two backlight drive circuits.

According to another implementation, the backlight driving module includes at least two backlight driving circuits, and each backlight driving circuit may respectively adopt a switch control sub-circuit, and the switch control sub-circuit provides a corresponding switch control signal for the switch sub-circuit in the backlight driving circuit.

The backlight circuit includes the backlight driving module described above.

In an implementation, the backlight driving module may include A backlight driving circuits; the backlight circuit further includes A light emitting units; each of the light emitting units includes M rows and N columns of light emitting elements; each light emitting unit corresponds to one backlight driving circuit. The backlight driving module includes a micro control circuit; the micro control circuit includes M switch control signal output ends; the backlight driving sub-circuit includes N voltage receiving ends; and the backlight driving circuit includes M switch sub-circuits; M, N, and A are all integers greater than one.

The mth switch control signal output end of the micro control circuit is connected to a control end of an mth switch sub-circuit in each of the backlight drive circuits, and the micro control circuit is configured to provide a corresponding switch control signal to the mth switch sub-circuit by the mth switch control signal output end. The nth voltage receiving end included in each backlight driving sub-circuit of the backlight driving circuit is connected to the first electrodes of all the light emitting elements located in the nth column of the corresponding light emitting units. The second electrodes of the light emitting elements in the mth row included in each of the light emitting units are connected to the first end of the mth switch sub-circuit in the corresponding backlight driving circuit; the second end of the switch sub-circuit is connected to the corresponding driving end; m is a positive integer less than or equal to M, and n is a positive integer less than or equal to N.

The backlight driving module will be described below.

Figure 6:
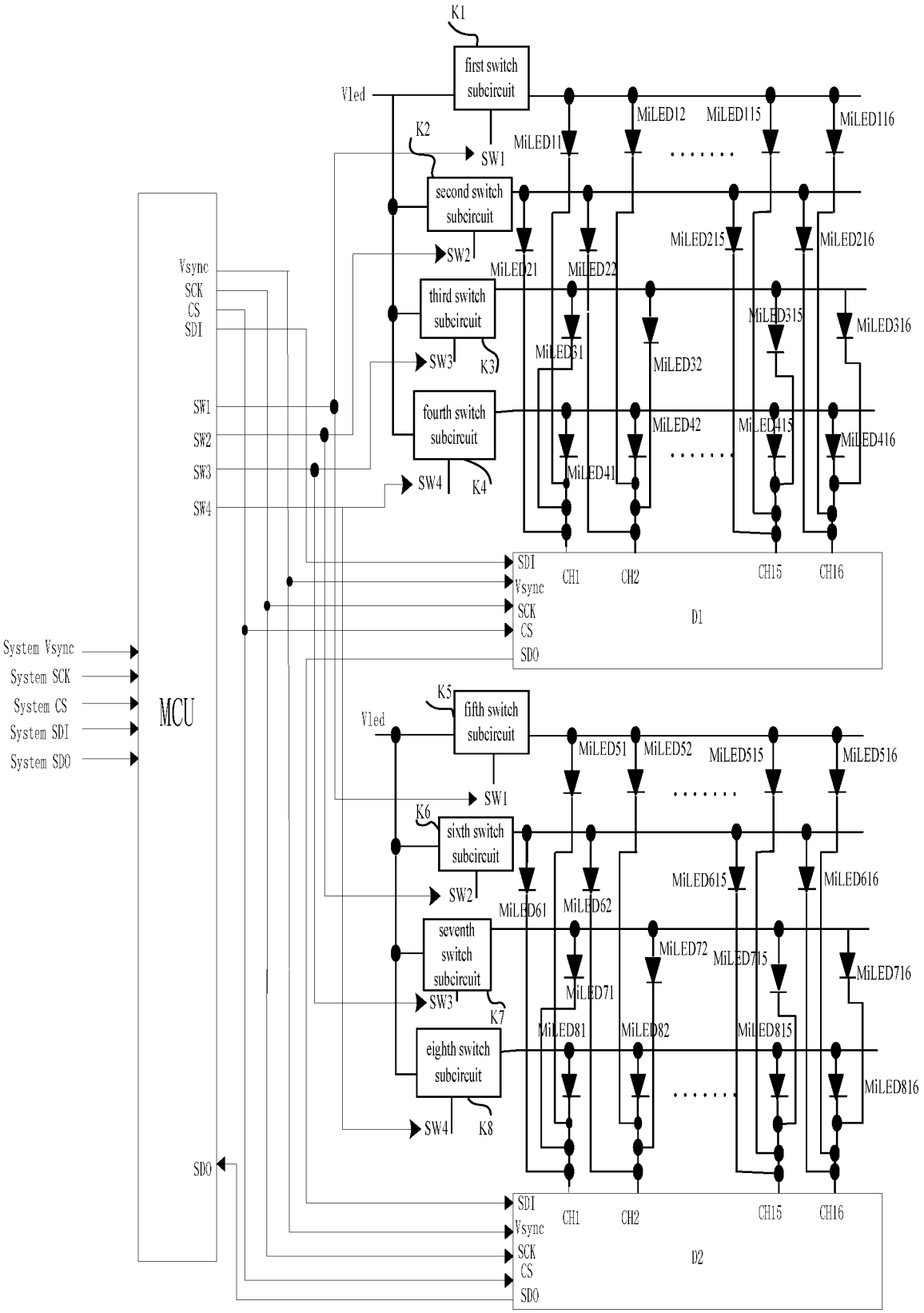
FIG. 6 is a circuit diagram of a backlight circuit according to at least one embodiment of the present disclosure.

As shown in FIG. 6, the backlight circuit of some embodiments of the present disclosure includes a micro control circuit MCU, a first backlight driving chip D1, a second backlight driving chip D2, a first light emitting unit, and a second light emitting unit.

The backlight circuit further includes a first switch sub-circuit K1, a second switch sub-circuit K2, a third switch sub-circuit K3, a fourth switch sub-circuit K4, a fifth switch sub-circuit K5, a sixth switch sub-circuit K6, a seventh switch sub-circuit K7, and an eighth switch sub-circuit K8.

The first light emitting unit corresponds to the first backlight driving chip D1, and the second light emitting unit corresponds to the second backlight driving chip D2.

Each backlight driving chip includes 16 voltage receiving ends, and only the first voltage receiving end labeled by CH1, the second voltage receiving end labeled by CH2, and the fifteenth voltage receiving end labeled by CH15, and the sixteenth voltage receiving end labeled by CH16 are shown in FIG. 6.

The first light emitting unit includes four rows and sixteen columns of light emitting elements. Only the first row and the first column of light emitting element labeled by MiLED11, the first row and the second column of light emitting element labeled by MiLED12, the first row and the fifteenth column of light emitting element labeled by MiLED115, the first row and the sixteenth column of light emitting element labeled by MiLED116, the second row and the first column of light emitting element labeled by MiLED21, the second row and the second column of light emitting element labeled by MiLED22, the second row and the fifteenth column of light emitting element labeled by MiLED215, the second row and the sixteenth column of light emitting element labeled by MiLED216, the third row and the first column of light emitting element labeled by MiLED31, the third row and the second column of light emitting element labeled by MiLED32, the third row and the fifteenth column of light emitting element labeled by MiLED315, the third row and the sixteenth column of light emitting element labeled by MiLED316, the fourth row and the first column of light emitting element labeled by MiLED41, the fourth row and the second column of light emitting element labeled by MiLED42, the fourth row and the fifteenth column of light emitting element labeled by MiLED415, the fourth row and the sixteenth column of light emitting element labeled by MiLED416 are shown in FIG. 6.

The second light emitting unit includes four rows and sixteen columns of light emitting elements. Only the fifth row and the first column of light emitting element labeled by MiLED51, the fifth row and the second column of light emitting element labeled by MiLED52, the fifth row and the fifteenth column of light emitting element labeled by MiLED515, the fifth row and the sixteenth column of light emitting element labeled by MiLED516, the sixth row and the first column of light emitting element labeled by MiLED61, the sixth row and the second column of light emitting element labeled by MiLED62, the sixth row and the fifteenth column of light emitting element labeled by MiLED615, the sixth row and the sixteenth column of light emitting element labeled by MiLED616, the seventh row and the first column of light emitting element labeled by MiLED71, the seventh row and the second column of light emitting element labeled by MiLED72, the seventh row and the fifteenth column of light emitting element labeled by MiLED715, the seventh row and the sixteenth column of light emitting element labeled by MiLED716, the eighth row and the first column of light emitting element labeled by MiLED81, the eighth row and the second column of light emitting element labeled by MiLED82, the eighth row and the fifteenth column of light emitting element labeled by MiLED815, the eighth row and the sixteenth column of light emitting element labeled by MiLED816 are shown in FIG. 6.

The control end of K1 receives the first switch control signal SW1 provided by the MCU, the control end of K2 receives the second switch control signal SW2 provided by the MCU, and the control end of K3 receives the third switch control signal SW3 provided by the MCU. The control end of K4 receives the fourth switch control signal SW4 provided by the MCU, and the control end of the K5 receives the first switch control signal SW1 provided by the MCU, and the control end of the K6 receives the second switch control signal SW2 provided by the MCU, and the control end of the K7 receives the third switch control signal SW3 provided by the MCU, the control end of the K8 receives the fourth switch control signal SW4 provided by the MCU.

The second end of K1, the second end of K2, the second end of K3, the second end of K4, the second end of K5, the second end of K6, the second end of K7, and the second end of K8 are all connected to a switch voltage Vled.

The anode of MiLED11, the anode of MiLED12, the anode of MiLED115 and the anode of MiLED116 are all connected to the first end of K1; the cathode of MiLED11, the cathode of MiLED12, the cathode of MiLED115, the cathode of MiLED116 are connected to the first voltage receiving end CH1 included in D1, the second voltage receiving end CH2 included in D1, the fifteenth voltage receiving end CH15 included in D1, the sixteenth voltage receiving end CH16 included in D1, respectively.

The anode of MiLED21, the anode of MiLED22, the anode of MiLED215 and the anode of MiLED216 are all connected to the first end of K2; the cathode of MiLED21, the cathode of MiLED22, the cathode of MiLED215, the cathode of MiLED216 are connected to the first voltage receiving end CH1 included in D1, the second voltage receiving end CH2 included in D1, the fifteenth voltage receiving end CH15 included in D1, the sixteenth voltage receiving end CH16 included in D1, respectively.

The anode of MiLED31, the anode of MiLED32, the anode of MiLED315 and the anode of MiLED316 are all connected to the first end of K3; the cathode of MiLED31, the cathode of MiLED32, the cathode of MiLED315, the cathode of MiLED316 are connected to the first voltage receiving end CH1 included in D1, the second voltage receiving end CH2 included in D1, the fifteenth voltage receiving end CH15 included in D1, the sixteenth voltage receiving end CH16 included in D1, respectively.

The anode of MiLED41, the anode of MiLED42, the anode of MiLED415 and the anode of MiLED416 are all connected to the first end of K4; the cathode of MiLED41, the cathode of MiLED42, the cathode of MiLED415, the cathode of MiLED416 are connected to the first voltage receiving end CH1 included in D1, the second voltage receiving end CH2 included in D1, the fifteenth voltage receiving end CH15 included in D1, the sixteenth voltage receiving end CH16 included in D1, respectively.

The anode of MiLED51, the anode of MiLED52, the anode of MiLED515 and the anode of MiLED516 are all connected to the first end of K5; the cathode of MiLED51, the cathode of MiLED52, the cathode of MiLED515, the cathode of MiLED516 are connected to the first voltage receiving end CH1 included in D1, the second voltage receiving end CH2 included in D1, the fifteenth voltage receiving end CH15 included in D1, the sixteenth voltage receiving end CH16 included in D1, respectively.

The anode of MiLED61, the anode of MiLED62, the anode of MiLED615 and the anode of MiLED616 are all connected to the first end of K6; the cathode of MiLED61, the cathode of MiLED62, the cathode of MiLED615, the cathode of MiLED616 are connected to the first voltage receiving end CH1 included in D1, the second voltage receiving end CH2 included in D1, the fifteenth voltage receiving end CH15 included in D1, the sixteenth voltage receiving end CH16 included in D1, respectively.

The anode of MiLED71, the anode of MiLED72, the anode of MiLED715 and the anode of MiLED716 are all connected to the first end of K7; the cathode of MiLED71, the cathode of MiLED72, the cathode of MiLED715, the cathode of MiLED716 are connected to the first voltage receiving end CH1 included in D1, the second voltage receiving end CH2 included in D1, the fifteenth voltage receiving end CH15 included in D1, the sixteenth voltage receiving end CH16 included in D1, respectively.

The anode of MiLED81, the anode of MiLED82, the anode of MiLED815 and the anode of MiLED816 are all connected to the first end of K8; the cathode of MiLED81, the cathode of MiLED82, the cathode of MiLED815, the cathode of MiLED816 are connected to the first voltage receiving end CH1 included in D1, the second voltage receiving end CH2 included in D1, the fifteenth voltage receiving end CH15 included in D1, the sixteenth voltage receiving end CH16 included in D1, respectively.

In FIG. 6, only the first column of light emitting elements, the second column of light emitting elements, the fifteenth column of light emitting elements, and the sixteenth column of light emitting elements in each row of light emitting elements are shown, and other columns of light emitting elements are not shown. The light emitting elements not shown have correspond connection relationships as the respective light emitting elements shown in FIG. 6.

In FIG. 6, a system synchronization signal is labeled System_Vsync, a chip synchronization signal is labeled Vsync, a clock signal is labeled SCK, an enable signal is labeled CS, and a first serial/parallel control signal is labeled SD1, a second serial/parallel control signal is labeled SD0.

The system clock signal is labeled System SCK in FIG. 6, the system enable signal is labeled System_CS, the first system serial/parallel control signal is labeled System_SDI, and the second system serial/parallel control signal is labeled System_SD0.

Figure 7:
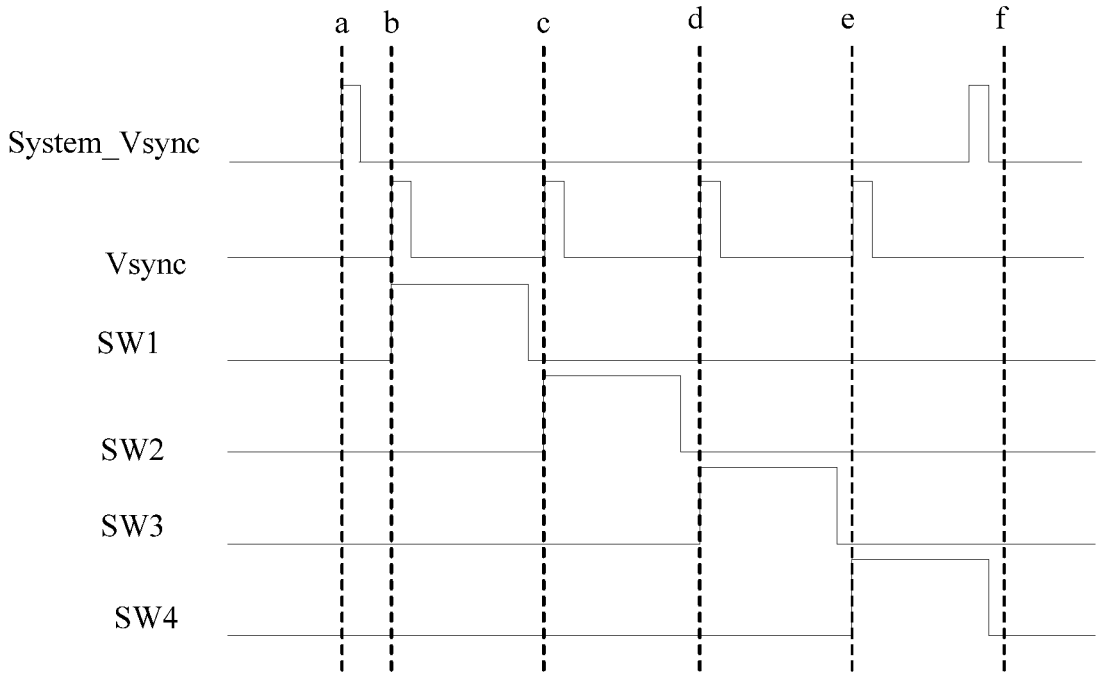
FIG. 7 is a time sequence diagram of the backlight driving circuit as shown in FIG. 6 according to at least one embodiment of the present disclosure.

As shown in FIG. 7, the backlight circuit shown in FIG. 6 is in operation, from time a to time b, D1 and D2 respectively receive corresponding system serial backlight data, and the system serial backlight data includes a pulse width modulation signal corresponding to the brightness of each light emitting element.

From time b to time c, SW1 is high level, SW2, SW3 and SW4 are low level, and each voltage receiving end of D1 receives a low voltage under the control of the corresponding first pulse width modulation signal to generate a corresponding backlight driving current; K1 is turned on, K2, K3 and K4 are all turned off, so that Vled is written into the anode of MiLED11, the anode of MiLED12, the anode of MiLED115 and the anode of MiLED116, and CH1 of D1 receives a low voltage under the control of the corresponding first pulse width modulation signal to generate the backlight driving current for driving MiLED 11, CH2 of D1 receives a low voltage under the control of the corresponding first pulse width modulation signal to generate the backlight driving current for driving MiLED 12, CH15 of D1 receives a low voltage under the control of the corresponding first pulse width modulation signal to generate the backlight driving current for driving MiLED 115, CH16 of D1 receives a low voltage under the control of the corresponding first pulse width modulation signal to generate the backlight driving current for driving MiLED 116, so that the sixteen sub-millimeter light emitting diodes in the first row of the first light emitting unit emit light in a time division manner, i.e. MiLED11, MiLED12 . . . MiLED115, MiLED116 in FIG. 6 emit light at respective time periods, and sub-millimeter light emitting diodes in other rows of the first light emitting unit do not emit light. Each voltage receiving end of D2 receives a low voltage under the control of the corresponding second pulse width modulation signal to generate a corresponding backlight driving current; K5 is turned on, K6, K7 and K8 are all turned off, so that Vled is written into the anode of MiLED51, the anode of MiLED52, the anode of MiLED515 and the anode of MiLED516, and CH1 of D2 receives a low voltage under the control of the corresponding second pulse width modulation signal to generate the backlight driving current for driving MiLED 51, CH2 of D2 receives a low voltage under the control of the corresponding second pulse width modulation signal to generate the backlight driving current for driving MiLED52, CH15 of D2 receives a low voltage under the control of the corresponding second pulse width modulation signal to generate the backlight driving current for driving MiLED 515, CH16 of D2 receives a low voltage under the control of the corresponding second pulse width modulation signal to generate the backlight driving current for driving MiLED 516, so that the sixteen sub-millimeter light emitting diodes in the fifth row of the first light emitting unit emit light in a time division manner, i.e. MiLED51, MiLED52 MiLED515, MiLED516 in FIG. 6 emit light at respective time periods, and sub-millimeter light emitting diodes in other rows of the first light emitting unit do not emit light.

From time c to time d, SW2 is high level, SW1, SW3 and SW4 are low level, and each voltage receiving end of D1 receives a low voltage under the control of the corresponding third pulse width modulation signal to generate a corresponding backlight driving current; K2 is turned on, K1, K3 and K4 are all turned off, so that Vled is written into the anode of MiLED21, the anode of MiLED22, the anode of MiLED215 and the anode of MiLED216, and CH1 of D1 receives a low voltage under the control of the corresponding third pulse width modulation signal to generate the backlight driving current for driving MiLED 21, CH2 of D1 receives a low voltage under the control of the corresponding third pulse width modulation signal to generate the backlight driving current for driving MiLED 22, CH15 of D1 receives a low voltage under the control of the corresponding third pulse width modulation signal to generate the backlight driving current for driving MiLED 215, CH16 of D1 receives a low voltage under the control of the corresponding third pulse width modulation signal to generate the backlight driving current for driving MiLED 216, so that the sixteen sub-millimeter light emitting diodes in the second row of the first light emitting unit emit light in a time division manner, i.e. MiLED21, MiLED22 . . . MiLED215, MiLED216 in FIG. 6 emit light at respective time periods, and sub-millimeter light emitting diodes in other rows of the first light emitting unit do not emit light. Each voltage receiving end of D2 receives a low voltage under the control of the corresponding fourth pulse width modulation signal to generate a corresponding backlight driving current; K6 is turned on, K5, K7 and K8 are all turned off, so that Vled is written into the anode of MiLED61, the anode of MiLED62, the anode of MiLED615 and the anode of MiLED616, and CH1 of D2 receives a low voltage under the control of the corresponding fourth pulse width modulation signal to generate the backlight driving current for driving MiLED 61, CH2 of D2 receives a low voltage under the control of the corresponding fourth pulse width modulation signal to generate the backlight driving current for driving MiLED62, CH15 of D2 receives a low voltage under the control of the corresponding fourth pulse width modulation signal to generate the backlight driving current for driving MiLED 615, CH16 of D2 receives a low voltage under the control of the corresponding fourth pulse width modulation signal to generate the backlight driving current for driving MiLED 616, so that the sixteen sub-millimeter light emitting diodes in the sixth row of the first light emitting unit emit light in a time division manner, i.e. MiLED61, MiLED62 . . . MiLED615, MiLED616 in FIG. 6 emit light at respective time periods, and sub-millimeter light emitting diodes in other rows of the first light emitting unit do not emit light.

From time d to time e, SW3 is high level, SW1, SW2 and SW4 are low level, and each voltage receiving end of D1 receives a low voltage under the control of the corresponding fifth pulse width modulation signal to generate a corresponding backlight driving current; K3 is turned on, K1, K2 and K4 are all turned off, so that Vled is written into the anode of MiLED31, the anode of MiLED32, the anode of MiLED315 and the anode of MiLED316, and CH1 of D1 receives a low voltage under the control of the corresponding fifth pulse width modulation signal to generate the backlight driving current for driving MiLED 31, CH2 of D1 receives a low voltage under the control of the corresponding fifth pulse width modulation signal to generate the backlight driving current for driving MiLED 32, CH15 of D1 receives a low voltage under the control of the corresponding fifth pulse width modulation signal to generate the backlight driving current for driving MiLED 315, CH16 of D1 receives a low voltage under the control of the corresponding fifth pulse width modulation signal to generate the backlight driving current for driving MiLED 316, so that the sixteen sub-millimeter light emitting diodes in the third row of the first light emitting unit emit light in a time division manner, i.e. MiLED31, MiLED32 . . . MiLED315, MiLED316 in FIG. 6 emit light at respective time periods, and sub-millimeter light emitting diodes in other rows of the first light emitting unit do not emit light. Each voltage receiving end of D2 receives a low voltage under the control of the corresponding sixth pulse width modulation signal to generate a corresponding backlight driving current; K7 is turned on, K5, K6 and K8 are all turned off, so that Vled is written into the anode of MiLED71, the anode of MiLED72, the anode of MiLED715 and the anode of MiLED716, and CH1 of D2 receives a low voltage under the control of the corresponding sixth pulse width modulation signal to generate the backlight driving current for driving MiLED 71, CH2 of D2 receives a low voltage under the control of the corresponding sixth pulse width modulation signal to generate the backlight driving current for driving MiLED72, CH15 of D2 receives a low voltage under the control of the corresponding sixth pulse width modulation signal to generate the backlight driving current for driving MiLED 715, CH16 of D2 receives a low voltage under the control of the corresponding sixth pulse width modulation signal to generate the backlight driving current for driving MiLED 716, so that the sixteen sub-millimeter light emitting diodes in the seventh row of the first light emitting unit emit light in a time division manner, i.e. MiLED71, MiLED72 . . . MiLED715, MiLED716 in FIG. 6 emit light at respective time periods, and sub-millimeter light emitting diodes in other rows of the first light emitting unit do not emit light.

From time e to time f, SW4 is high level, SW1, SW2 and SW3 are low level, and each voltage receiving end of D1 receives a low voltage under the control of the corresponding seventh pulse width modulation signal to generate a corresponding backlight driving current; K4 is turned on, K1, K2 and K3 are all turned off, so that Vled is written into the anode of MiLED41, the anode of MiLED42, the anode of MiLED415 and the anode of MiLED416, and CH1 of D1 receives a low voltage under the control of the corresponding seventh pulse width modulation signal to generate the backlight driving current for driving MiLED 41, CH2 of D1 receives a low voltage under the control of the corresponding seventh pulse width modulation signal to generate the backlight driving current for driving MiLED 42, CH15 of D1 receives a low voltage under the control of the corresponding seventh pulse width modulation signal to generate the backlight driving current for driving MiLED 415, CH16 of D1 receives a low voltage under the control of the corresponding seventh pulse width modulation signal to generate the backlight driving current for driving MiLED 416, so that the sixteen sub-millimeter light emitting diodes in the fourth row of the first light emitting unit emit light in a time division manner, i.e. MiLED41, MiLED42 . . . MiLED415, MiLED416 in FIG. 6 emit light at respective time periods, and sub-millimeter light emitting diodes in other rows of the first light emitting unit do not emit light. Each voltage receiving end of D2 receives a low voltage under the control of the corresponding eighth pulse width modulation signal to generate a corresponding backlight driving current; K8 is turned on, K5, K6 and K7 are all turned off, so that Vled is written into the anode of MiLED81, the anode of MiLED82, the anode of MiLED815 and the anode of MiLED816, and CH1 of D2 receives a low voltage under the control of the corresponding eighth pulse width modulation signal to generate the backlight driving current for driving MiLED 81, CH2 of D2 receives a low voltage under the control of the corresponding eighth pulse width modulation signal to generate the backlight driving current for driving MiLED82, CH15 of D2 receives a low voltage under the control of the corresponding eighth pulse width modulation signal to generate the backlight driving current for driving MiLED 815, CH16 of D2 receives a low voltage under the control of the corresponding eighth pulse width modulation signal to generate the backlight driving current for driving MiLED 816, so that the sixteen sub-millimeter light emitting diodes in the eighth row of the first light emitting unit emit light in a time division manner, i.e. MiLED81, MiLED82 MiLED815, MiLED816 in FIG. 6 emit light at respective time periods, and sub-millimeter light emitting diodes in other rows of the first light emitting unit do not emit light.

The backlight circuit shown in FIG. 6 is configured to output a switch control signal through an MCU, and includes a switch sub-circuit built by discrete devices, so as to realize the backlight driving channel multiplexing of the backlight driving chip, reduce the quantity of the backlight drive chips and reduce the cost of the backlight circuit.

In the backlight circuit shown in FIG. 6, the description is made by taking two backlight driving chips as an example. In actual operation, the number of backlight driving chips used in the backlight circuit can be selected according to actual conditions, and can be any integer greater than one.

The display device includes the backlight circuit described above.

The display device provided by some embodiments of the present disclosure may be any product or component having a display function, such as a mobile phone, a tablet computer, a television, a display, a notebook computer, a digital photo frame, a navigator, and the like.

The above are merely the preferred embodiments of the present disclosure, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A backlight driving circuit, comprising:

at least two switch sub-circuits;

at least two driving ends; and a backlight driving sub-circuit, wherein the backlight driving sub-circuit comprises at least one voltage receiving end;

the voltage receiving end is connected to first electrodes of at least two light emitting elements, second electrodes of the at least two light emitting elements are connected to first ends of the at least two switch sub-circuits, respectively; and a control end of each switch sub-circuit receives a switch control signal, a second end of the switch sub-circuit is connected to a corresponding driving end, a first end of the switch sub-circuit and the second end of the switch sub-circuit are connected or disconnected under the control of the switch control signal, wherein the switch sub-circuit comprises a first switching transistor, a second switching transistor, a first resistor, a second resistor, a third resistor, and a fourth resistor;

a first electrode of the first switching transistor is the first end of the switch sub-circuit, and a second electrode of the first switching transistor is the second end of the switch sub-circuit;

a gate electrode of the second switching transistor is the control end of the switch sub-circuit, and a first electrode of the second switching transistor is connected to a gate electrode of the first switching transistor through the second resistor, the second electrode of the second switching transistor is connected to a low level input end;

the first resistor is connected between the first electrode of the first switching transistor and the gate electrode of the first switching transistor, and the third resistor is connected to the gate electrode of the second switching transistor and the low level input end; and the first switching transistor is a p-type transistor, and the second switching transistor is an n-type transistor.

2. The backlight driving circuit according to claim 1, wherein a first electrode of the light emitting element is cathode, and a second electrode of the light emitting element is anode, the driving end is configured to input a turn-on voltage, and the backlight driving sub-circuit is configured to control a corresponding voltage receiving end to receive a first voltage under the control of a corresponding pulse width modulation signal, the first voltage is less than the turn-on voltage, and a voltage difference between the turn-on voltage and the first voltage is greater than a voltage for turning on the light emitting element.

3. The backlight driving circuit according to claim 2, wherein the backlight driving sub-circuit further comprises at least one current control unit, and each current control unit corresponds to a voltage receiving end;

the current control unit comprises a switch module and a current control module;

a first end of the switch module is connected to a corresponding voltage receiving end, a second end of the switch module is connected to a corresponding first voltage input end, and a control end of the switch module receives a corresponding pulse width modulation signal, the corresponding voltage receiving end and the corresponding first voltage input end are connected or disconnected by the switch module under the control of the corresponding pulse width modulation signal, the first voltage input end is configured to input the first voltage; and the current control module is configured to, when the corresponding voltage receiving end and the corresponding first voltage input end are connected by the switch module, adjust a current value of a backlight driving current flowing through the light emitting element to a predetermined current value by adjusting the turn-on voltage.

4. The backlight driving circuit according to claim 3, wherein a duty ratio of the pulse width modulation signal is adjusted to control a turn-on time period of the switch module, to control brightness of light emitted by the light emitting element.

5. The backlight driving circuit according to claim 1, wherein a first electrode of the light emitting element is anode and a second electrode of the light emitting element is cathode, the driving end is configured to input a cathode voltage, and the backlight driving sub-circuit is configured to control the corresponding voltage receiving end to receive a second voltage under the control of a corresponding pulse width modulation signal, the second voltage is greater than the cathode voltage, and a voltage difference between the second voltage and the cathode voltage is greater than a voltage for turning on the light emitting element.

6. The backlight driving circuit according to claim 5, wherein the backlight driving sub-circuit further comprises at least one current control unit, and each current control unit corresponds to a voltage receiving end;

the current control unit comprises a switch module and a current control module;

a first end of the switch module is connected to a corresponding voltage receiving end, a second end of the switch module is connected to a corresponding second voltage input end, and a control end of the switch module receives a corresponding pulse width modulation signal, the switch module is configured to connect or disconnect the corresponding voltage receiving end and the corresponding second voltage input end under the control of the corresponding pulse width modulation signal, the second voltage input end is configured to input the second voltage; and the current control module is configured to, when the switch module connects the corresponding voltage receiving end and the corresponding second voltage input end, adjust a current value of a backlight driving current flowing through the corresponding light emitting element to a predetermined current value by adjusting the cathode voltage.

7. A backlight driving method, applied to the backlight driving circuit according to claim 1, wherein a backlight driving period includes N driving stages sequentially, and N is an integer greater than 1, the backlight driving method comprises:

in an nth driving stage, connecting, by an nth switch sub-circuit included in the backlight driving circuit, a first end of the nth switch sub-circuit and a second end of the nth switch sub-circuit under the control of a switching control signal; other switch sub-circuits included in the backlight driving circuit disconnecting the first ends and the second ends of the other switch sub-circuits; and n being a positive integer less than or equal to N.

8. The backlight driving method according to claim 7, wherein the first electrode of the light emitting element is cathode, the second electrode of the light emitting element is anode, and the backlight driving method further comprises:

in the nth driving stage, an nth driving end of the backlight driving circuit inputting an nth turn-on voltage, and controlling, by the backlight driving sub-circuit, a corresponding voltage receiving end to receive a first voltage under the control of a corresponding pulse width modulation signal, the first voltage being less than the nth turn-on voltage.

9. The backlight driving method according to claim 8, wherein a duty ratio of the pulse width modulation signal is adjusted to control a time period of the corresponding voltage receiving end receiving the first voltage, to control brightness of light emitted by the light emitting element.

10. The backlight driving method according to claim 7, wherein the first electrode of the light emitting element is anode, the second electrode of the light emitting element is cathode, and the backlight driving method further comprises:

in the nth driving stage, an nth driving end of the backlight driving circuit inputting an nth cathode voltage, and controlling, by the backlight driving sub-circuit, a corresponding voltage receiving end to receive a second voltage under the control of a corresponding pulse width modulation signal, the second voltage being greater than the nth cathode voltage.

11. The backlight driving method according to claim 10, wherein a duty ratio of the pulse width modulation signal is adjusted to control a time period of the corresponding voltage receiving end receiving the second voltage, to control brightness of light emitted by the light emitting element.

12. A backlight driving module, comprising at least two backlight driving circuits according to claim 1.

13. The backlight driving module according to claim 12, wherein the backlight driving circuit comprises a switch control sub-circuit, the backlight driving module comprises a micro control circuit, and the switch control sub-circuit is disposed in the micro control circuit; and the backlight driving sub-circuit comprises a backlight driving chip.

14. A backlight circuit, comprising the backlight driving module according to claim 12.

15. The backlight circuit according to claim 14, wherein the backlight driving module comprises A backlight driving circuits; the backlight circuit further comprises A light emitting units; each light emitting unit comprises M rows and N columns of light emitting elements; each light emitting unit corresponds to one backlight driving circuit;

the backlight driving module comprises a micro control circuit; the micro control circuit includes M switch control signal output ends; the backlight driving sub-circuit includes N voltage receiving ends; and the backlight driving circuit includes M switch sub-circuits; M, N, and A are all integers greater than one;

an mth switch control signal output end of the micro control circuit is connected to a control end of an mth switch sub-circuit in each backlight drive circuit, and the micro control circuit is configured to provide a switch control signal to the mth switch sub-circuit by the mth switch control signal output end;

an nth voltage receiving end included in backlight driving sub-circuit of each backlight driving circuit is connected to first electrodes of all the light emitting elements located in an nth column of the corresponding light emitting unit;

second electrodes of the light emitting elements in an mth row of each light emitting unit are connected to a first end of the mth switch sub-circuit in the corresponding backlight driving circuit; a second end of the mth switch sub-circuit is connected to the corresponding driving end; and m is a positive integer less than or equal to M, and n is a positive integer less than or equal to N.

16. A display device, comprising the backlight circuit according to claim 14.

17. A backlight driving circuit, comprising:

at least two switch sub-circuits;

at least two driving ends; and a backlight driving sub-circuit, wherein the backlight driving sub-circuit comprises at least one voltage receiving end;

the voltage receiving end is connected to first electrodes of at least two light emitting elements, second electrodes of the at least two light emitting elements are connected to first ends of the at least two switch sub-circuits, respectively; and a control end of each switch sub-circuit receives a switch control signal, a second end of the switch sub-circuit is connected to a corresponding driving end, a first end of the switch sub-circuit and the second end of the switch sub-circuit are connected or disconnected under the control of the switch control signal, wherein the switch sub-circuit includes a switching transistor, a first resistor, a second resistor, and a third resistor;

a gate electrode of the switching transistor is connected to a first end of the second resistor, a first electrode of the switching transistor is the first end of the switch sub-circuit, and a second electrode of the switching transistor is the second end of the switch sub-circuit;

a second end of the second resistor is the control end of the switch sub-circuit;

the first resistor is connected between the gate electrode of the switching transistor and the first electrode of the switching transistor, and the third resistor is connected between to the second electrode of the switching transistor and a low level input end; and the switching transistor is a p-type transistor.

18. The backlight driving circuit according to claim 1, further comprising a switch control sub-circuit, wherein the switch control sub-circuit is configured to provide a switch control signal to each of the control ends of the at least two switch sub-circuits, to connect the first ends and the second ends of the at least two switch sub-circuits in a time division manner.

19. The backlight driving circuit according to claim 1, wherein the light emitting element is a sub-millimeter light emitting diode or a micro light emitting diode.

* * * * *